United States Patent [19]

Fietta

[11] Patent Number: 4,773,342

[45] Date of Patent: Sep. 27, 1988

[54] CONTROL DEVICE FOR TRIMMING KNIVES IN FLAT-BED SEWING MACHINES

[75] Inventor: Emilio Fietta, Milan, Italy

[73] Assignee: Rockwell-Rimoldi S.p.A., Italy

[21] Appl. No.: 145,163

[22] Filed: Jan. 19, 1988

[30] Foreign Application Priority Data

Apr. 30, 1987 [IT] Italy ..... 28900/87[U]

[51] Int. Cl.[4] ..... D05B 37/06

[52] U.S. Cl. ..... 112/129; 112/122

[58] Field of Search ..... 112/122, 129

[56] References Cited

U.S. PATENT DOCUMENTS

| | | | |
|---|---|---|---|
| 4,269,127 | 5/1981 | Kamiya | 112/122 |
| 4,384,540 | 5/1983 | Vollmar | 112/129 |
| 4,603,647 | 8/1986 | Conley, Jr. et al. | 112/129 |
| 4,649,841 | 3/1987 | Koshinaka | 112/129 |

*Primary Examiner*—Andrew M. Falik

[57] ABSTRACT

A control device for trimming knives on flat-bed sewing machines comprises a rocking lever 19 fulcrumed on a fixed pivot 20 and receiving an oscillatory motion from a connecting rod 18. The rocking lever operates a movable knife 14 through a drive group 21 provided with a movable pivot 29 slidably engaged in an elongate shaped opening 30 associated with the the rocking lever. A disengagement group 40 enables the movable pivot 29 to be brought from an engagement position in which it is in engagement with an engagement portion 30*b* of the elongate shaped opening 30 to operate the movable knife 14, to a disengagement position in which the movable pivot slides within a curvilinear portion 30*a* of the elongate opening in order to deactivate the movable knife 14. The displacements of the movable pivot 29 take place upon command of a disengagement lever 32 slidably engaging said pivot in the region of an elongate guide opening 32*a.* The movable pivot is axially locked by a plate 38 fastened to the disengagement lever 32 by means of a screw 39 and provided with an elongate slide opening 38*a* engaging the pivot in the region of a circumferential groove 41 formed thereon.

2 Claims, 1 Drawing Sheet

1
5
4
6
37
3
3a
7
8
9
14
10a
13
23
12
11
10
15
17
18
16
19
33
32
39
36
35
40
34a
34
26
23a
24
21
42
2
36

16
18
19a
30
30a
30b
31
17
14
13
21
24
25
28
20
19
29a
41
29
38a
39
38
32a
33
32
26
27
22
23
23a 38a
29
32
28
27
22
39
38
33
26

CONTROL DEVICE FOR TRIMMING KNIVES IN FLAT-BED SEWING MACHINES

BACKGROUND OF THE INVENTION

1. Field of the Invention

The present invention relates to a control device for trimming knives in flat-bed sewing machines of the type comprising a control eccentric mounted on a rotating shaft and operatively engaged with a connecting rod acting upon a rocking lever oscillatably engaged on a fixed pivot and provided with an elongate shaped opening having a curvilinear portion extending concentrically with the axis of the fixed pivot and an adjoining engagement seat portion extending substantially radially to the fixed pivot; a drive group for a movable knife operated by the rocking lever through a connecting member linked to the latter by means of a movable pivot slidably passing through the elongate shaped opening; and a disengagement group comprised of a disengagement lever supported by a control spindle and provided with an elongate guide opening through which a side portion of said movable pivot is slidably engaged, said disengagement lever being oscillatable, through the rotation of said control spindle, from an engagement position in which the movable pivot is in engagement with the engagement seat portion of said elongate shaped opening and the elongate guide opening extends concentrically with the axis of the fixed pivot, to a disengagement position in which the movable pivot is in engagement with the curvilinear portion of the elongate shaped opening.

2. Prior Art

It is known that industrial flat-bed sewing machines are often provided, for the accomplishment of particular workings, with trimming knives acting through the work-supporting table to carry out a cutting action on at least one of the fabrics being worked during the execution of a seam.

In greater detail, the cutting or trimming of a fabric is carried out by virtue of the combined action of a fixed knive disposed substantially flush with the work-supporting table through an opening formed in the latter and a movable knife oscillating through the opening itself in a substantially vertical direction.

The movable knife is driven by a control device enclosed in the sewing machine bed under the work-supporting table. Such a device summarily comprises a drive group imparting the oscillatory motion to the movable knife through an eccentric mounted on a rotating shaft and with which a connecting rod acting on a rocking lever, is associated. A connecting member is engaged on either side to the rocking lever and to an arm carried by a countershaft to which the movable knife is fastened. In this way the oscillatory motion imparted to the rocking lever by the connecting rod is transmitted to the movable knife through the above mentioned connecting member, arm and countershaft.

The control device further comprises a disengagement group enabling an operator to prevent the knives from working during the operation of the sewing machine.

The above mentioned connecting member is connected to the rocking lever by means of a movable pivot in engagement through an elongate shaped opening formed in the lever. Said elongate shaped opening has a curvilinear portion extending concentrically with the pivoting axis of the rocking lever and an adjoining engagement seat portion disposed substantially radially to the above mentioned axis.

One side portion of the movable pivot is also engaged in an elongate guide opening formed in a disengagement lever supported by a control spindle and said movable pivot is fixed in an axial direction by means of an enlarged end abutting against the connecting member and a screw threaded element abutting against the disengagement lever.

The spindle supporting the disengagement lever has an arm connected by a Bowden cable to a knee control mounted externally to the sewing machine frame. Acting upon the knee control it is possible to rotate the spindle angularly; as a result, the disengagement lever moves the movable pivot along the elongate shaped opening from an engagement position in which the pivot is engaged with the engagement seat portion to a disengagement position in which it is engaged with the curvilinear portion of the elongate shaped opening.

When the movable pivot is in its engagement position it is involved in the oscillations of the rocking lever causing the operation of the movable knife via the members forming the rest of the drive group.

On the contrary, when the pivot is engaged with the curvilinear portion of the elongate opening it is not subjected to perform any oscillation and the movable knife remains therefore inactive.

Although the devices of the above described type can perfectly perform the functions they are intended for, they involve some problems when, due to particular workings to be carried out, they have to be removed from the sewing machine, being then necessary to put them in place again after some time.

These problems originate from the fact that such devices, after being mounted on a sewing machine, cannot be removed therefrom if the above mentioned control eccentric is not first removed. As a result when the device has to be mounted again, it takes a long time to carry out the eccentric timing in order to make the trimming knives operate in synchronism with all the other members of the sewing machine.

SUMMARY OF THE INVENTION

It is an object of the present invention to solve the above mentioned drawback by providing a control device for trimming knives which is set up in such a manner that it can be readily removed from the sewing machine without the dismantling of the control eccentric associated therewith being necessary.

The foregoing and further objects that will become more apparent in the course of the following description are substantially achieved by a control device for trimming knives in flat-bed sewing machines, comprising at least a plate fastened to one side of the disengagement lever from which the control spindle extends and provided with an elongate slide opening slidably engaging the movable pivot in the region of a circumferential groove thereof in order to axially lock it, said elongate slide opening having the same development as the elongate guide opening but being slightly less wide than the latter.

BRIEF DESCRIPTION OF THE DRAWINGS

Further features and advantages will best be understood from the detailed description of a preferred embodiment of a control device for trimming knives in flat-bed sewing machines, according to the present invention, given hereinafter by way of non-limiting example with reference to the accompanying drawings, in which.

DESCRIPTION OF THE PREFERRED EMBODIMENT

Figure 1:
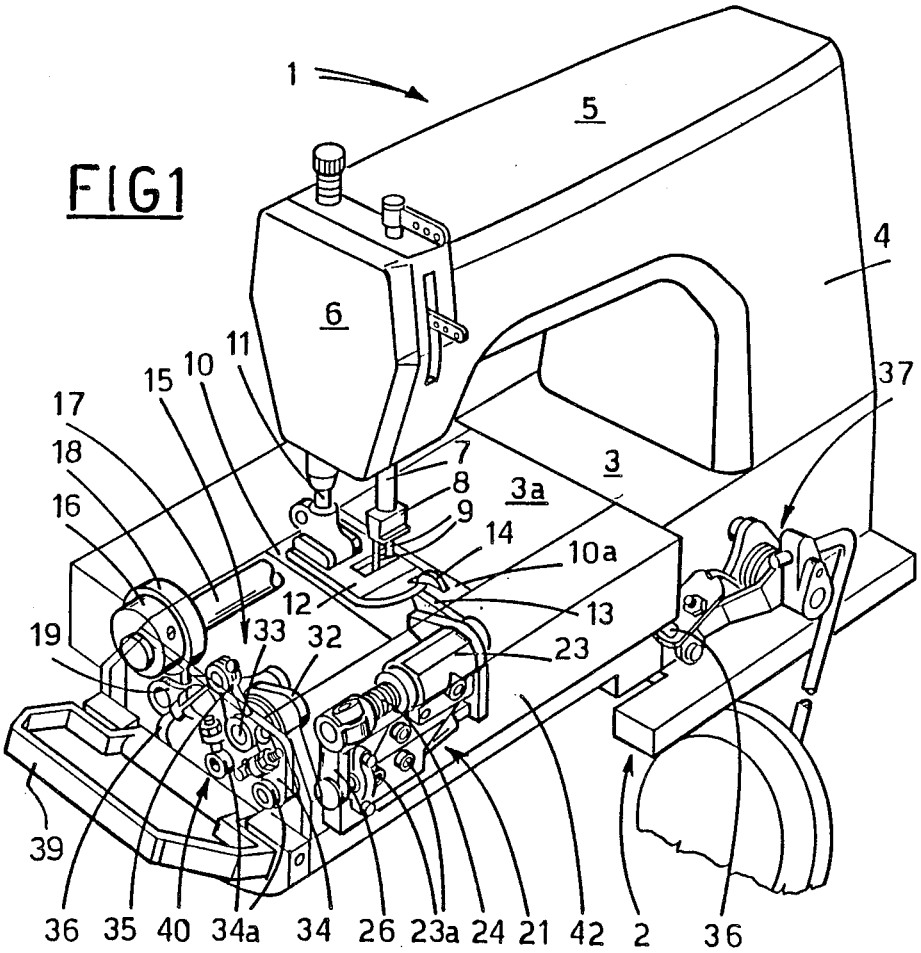
FIG. 1 is a perspective view diagrammatically showing a sewing machine embodying the device of the present invention.

Referring to the drawings and particularly to FIG. 1, a flat-bed sewing machine having a control device for trimming knives according to the present invention associated therewith, has been globally identified by reference numeral 1.

The sewing machine 1 has a frame 2 comprised of a bed 3 defining a work-supporting table 3*a* at its upper part. A post 4 rises up from the machine bed 3 and carries a support arm 5 in cantilevered fashion, said arm terminating in a needle-holding head 6. A needle bar 7 is slidably accommodated in the needle-holding head 6; it can be imparted a reciprocating movement in a substantially vertical direction and at its lower part supports one or more needles 9 through a clamp 8.

Said needles are designed to operate through a needle plate 10 disposed flush with the work-supporting plate 3*a* to carry out the sewing of fabrics being worked in cooperation with lower sewing instrumentalities not shown and housed in the machine bed 3 underneath the work-supporting table 3*a*.

Also housed in the head 6 is a presser foot holder 11 provided, at its lower end, with a presser foot 12 urged against the needle plate 10 by known and conventional spring means.

The sewing machine 1 further comprises a pair of trimming knives, that is a fixed knife 13 and a movable knife 14 acting in the region of an opening 10*a* formed in the needle plate 10 at the front of the presser foot 12 to perform a cutting action on at least one fabric being worked.

Knives 13 and 14 are operated by a control device globally identified by reference numeral 15, which is the subject of the present invention.

Figure 2:
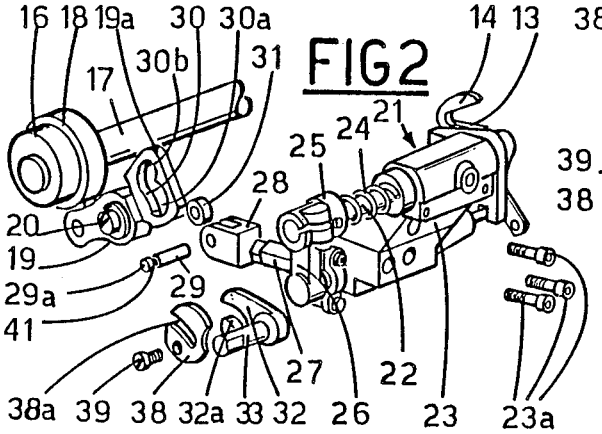
FIG. 2 is a perspective and partially exploded view of the drive group being part of the device in question.
Figure 3:
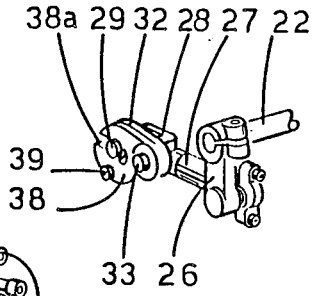
FIG. 3 shows, in a perspective view, the connection between the drive group and disengagement group being part of the device in accordance with the present invention.

The control device 15 is housed within the machine bed 3 at the end thereof opposite the post 4 and is operated in a conventional manner by an eccentric 16 mounted on a rotating shaft 17 rotatably accommodated in the machine-bed. A connecting rod 18 acting upon a rocking lever 19 shown in greater detail in FIG. 2 is operatively engaged to the eccentric 16; it is rotatably engaged, at a midpoint of its longitudinal extension, on a fixed pivot 20 extending from a wall not shown. Said wall rises up vertically in bed 3 and conventionally houses the main bearings designed to support the shaft 17 as well as other members provided in the sewing machine.

The rocking lever 19 is adapted to cause the operation of knives 13 and 14 by means of a drive group 21 comprised of a countershaft 22 fixedly supporting the movable knife 14 at one end thereof and rotatably and slidably engaging in a support 23 detachably secured to the machine bed 3 by means of threaded members 23*a*. Fastened to the end of the support 23 facing the movable knife 14 is the fixed knife 13.

The movable knife 14 is urged against the fixed knife 13 by the action of a coil spring 24 surrounding the countershaft 22 and acting between a locating collar 25 suitable to be positioned along the countershaft itself and the end of the support 23 opposite the knives 13 and 14.

Fixedly engaged to the countershaft 22, at the end thereof opposite the knife 14, is an arm 26 rotatably carrying a connecting member 27 at its free end. The connecting member 27 is provided, on its side opposite the arm 26, with a fork-shaped element 28 the two limbs of which receive a plate-like portion 19*a* of the rocking lever 19.

In an original manner, the connecting member 27 is joined to the rocking lever 19 by means of a movable pivot 29 slidably passing through the limbs of the fork-shaped element 28 and the plate-like portion 19*a* interposed therebetween and provided to this end with an elongate shaped opening 30. In greater detail, it is provided that the engagement between the movable pivot 29 and the elongate shaped opening 30 should take place through the interposition of a roller 31 rotatably located on the pivot itself so that it is disposed between the limbs of the fork-shaped element 28.

The elongate shaped opening 30 has a curvilinear portion 30*a* extending concentrically with the axis of the fixed pivot 20 and a portion 30*b* forming an engagement seat, extending radially to the axis of the fixed pivot.

The control device 15 further comprises a disengagement group 40 allowing the appropriate positioning of pivot 29 along the elongate shaped opening 30 in order to cause the activation or deactivation of the movable knife 14.

Said disengagement group comprises a disengageament lever 32 provided with an elongate guide opening 32*a* within which a projecting portion of the movable pivot 29 is slidably engaged.

The disengagement lever 32 is supported by a control spindle 33 rotatably guided by means of a support plate 34 removably fixed to the bed 3 by means of threaded members 34*a*. The control spindle 33 completely crosses the support plate 34 and one of its ends projects therefrom, to said end being fastened a control arm 35 connected, through a flexible Bowden cable 36, to a knee control group 37 mounted externally to the frame 2 and not described herein as it is not important to the disclosed invention.

In known manner, acting upon the knee control 37 an operator can control the activation or deactivation of knives 13 and 14.

In greater detail, in the absence of the operator's intervention upon the knee control 37, the disengagement lever 32 is maintained, through spring means not shown as already known in itself, in an engagement position in which the movable pivot 29 is engaged through the roller 31 within the engagement seat 30*b* of the elongate shaped opening 30. Under this situation the movable pivot 29 is involved in the oscillations imparted to the rocking lever 19 by the connecting rod 18 and it is therefore subjected to carry out a reciprocating motion about the axis of the fixed pivot 20.

The oscillations of the movable pivot 29 are transmitted to the movable knife 14 through the connecting member 27, arm 26 and countershaft 22.

In known manner, the elongate guide opening 32*a* formed in the disengagement lever 32 is shaped such as to extend, in the above described engagement condition, concentrically with the axis of the fixed pivot 20, in order to guide the oscillatory motion of the movable pivot 29.

When the operator acts upon the knee control 37, he causes the control spindle 33 to rotate angularly by means of the Bowden cable 36 and arm 35. As a result, the disengagement lever 31 is brought to a disengagement position dragging along the movable pivot 29 which reaches the curvilinear portion 30*a* in the elongate shaped opening 30. Under this situation the oscillations performed by the rocking lever 19 do not cause any displacement of the movable pivot 29, since the shape of the curvilinear portion 30*a* allows the latter to slide freely on roller 31. As a result, the movable knife 14 is not working during the operation of the sewing machine.

Advantageously and in an original manner, according to the present invention, it is provided that the movable pivot 29 should be fixedly restrained during its axial displacement by a plate 38 fastened to the side of lever 32 from which the control spindle 33 extends, preferably in a detachable manner, by means of one or more threaded members 39. Plate 38 is provided with an elongate slide opening 38*a* having the same shape as the elongate guide opening 32*a* but being slightly less wide than the latter so that it may engage the movable pivot 29 in the region of a circumferential groove 41 formed in the projecting portion 29*a* of said pivot. As a result, the movable pivot 29 can freely slide along the elongate slide and guide openings, 38*a* and 32*a* respectively, but it is hindered as regards its axial movement so that its disengagement in operation from the fork-shaped member 29, rocking lever 19 and disengagement lever 32 is prevented.

Advantageously, the engagement of the movable pivot 29 by means of plate 38 enables the control device 15 to be removed without being obliged to dismantle the control eccentric 16.

Actually, the removal of the control device 15 takes place as follows.

After disengaging the Bowden cable 36, in known manner, from arm 35 it is possible to carry out the removal of the disengagement group 40 by dismantling the threaded members 34*a* that become accessible by opening a tilting cover 39 located at the end portion of base 3. Being that the movable pivot 29 is secured to plate 38 in the manner described above, by dismantling the disengagement group 40 the movable pivot 29 is caused to slide off the fork-shaped element 28 and the rocking lever 19. As a result the connecting member 27 is disengaged from the rocking lever.

At this point the drive group 21 can be removed from the machine bed 3 as well by dismantling the threaded members 23*a* accessible through the removal of the detachable element 42 provided on bed 3.

The present invention attains the intended purposes.

In fact the control device 15 can be readily removed from the sewing machine without being necessary to dismantle the control eccentric 16 and consequently the device can be easily put in place again by inversely carrying out the sequence of operations described with reference to its removal, no timing operations being necessary for the eccentric.

Obviously the invention is susceptible of many modifications and variations which all come within the scope of the inventive idea characterizing it.

What is claimed is:

1. A control device for trimming knives in flat-bed sewing machines comprising a stationary knife and a movable knife from which a relative movement therebetween effects a cutting action on a fabric, wherein said control device comprises:

a control eccentric mounted on a rotating shaft and operatively engaged with a connecting rod acting upon a rocking lever oscillatably engaged on a fixed pivot and provided with an elongate shaped opening having a curvilinear portion extending concentrically with the axis of the fixed pivot and an adjoining engagement seat portion extending substantially radially to the fixed pivot;

a drive group for the movable knife operated by the rocking lever through a connecting member linked to the latter by means of a movable pivot slidably passing through the elongate shaped opening;

a disengagement group comprised of a disengagement lever supported by a control spindle and provided with an elongate guide opening through which a side portion of said movable pivot is slidably engaged, said disengagement lever being oscillatable, through the rotation of said control spindle, from an engagement position in which the movable pivot is in engagement with an engagement seat portion of said elongate shaped opening and the elongate guide opening extends concentrically with the axis of the fixed pivot, to a disengagement position in which the movable pivot is in engagement with the curvilinear portion of the elongate shaped opening, comprising at least a plate fastened to one side of the disengagement lever from which the control spindle extends and provided with an elongate slide opening slidably engaging the movable pivot in the region of a circumferential groove thereof in order to axially lock it, said elongate slide opening having the same development as the elongate guide opening but being slightly less wide than the latter.

2. The device as claimed in claim 1, wherein the said plate is detachably engaged to the disengagement lever by means of at least a screw threaded member.

* * * * *